United States Patent [19]

Siddoway et al.

[11] Patent Number: 4,793,656

[45] Date of Patent: Dec. 27, 1988

[54] IN-SITU COAL DRYING

[75] Inventors: Mark A. Siddoway; Timothy S. Westby, both of Houston, Tex.

[73] Assignee: Shell Mining Company, Houston, Tex.

[21] Appl. No.: 14,421

[22] Filed: Feb. 12, 1987

[51] Int. Cl.[4] ..... F21B 43/24; E21C 37/16

[52] U.S. Cl. ..... 299/14; 34/15; 166/260

[58] Field of Search ..... 299/14, 8; 166/260, 166/302, 303, 256; 34/9, 15, 39

[56] References Cited

U.S. PATENT DOCUMENTS

| | | | |
|---|---|---|---|
| 3,552,031 | 1/1971 | Evans | 34/9 |
| 3,823,775 | 7/1974 | Parsons et al. | 166/260 |
| 3,987,852 | 10/1976 | Terry | 166/260 X |
| 3,992,784 | 11/1976 | Verschuur | 34/12 |
| 4,052,168 | 10/1977 | Koppelman | 44/1 |
| 4,126,519 | 11/1978 | Murray | 201/32 |
| 4,285,140 | 8/1981 | Van Raam | 34/15 |
| 4,376,598 | 3/1983 | Brouns et al. | 299/14 X |
| 4,502,227 | 3/1985 | Janusch | 34/15 X |
| 4,615,391 | 10/1986 | Garthoffner | 166/257 |
| 4,617,744 | 10/1986 | Siddoway | 34/168 |
| 4,638,863 | 1/1987 | Wilson | 166/248 |
| 4,638,864 | 1/1987 | Bousaid | 166/251 |
| 4,670,634 | 6/1987 | Bridges et al. | 299/14 X |
| 4,674,195 | 6/1987 | Janusch | 34/15 X |

FOREIGN PATENT DOCUMENTS

| | | | |
|---|---|---|---|
| 903813 | 2/1954 | Fed. Rep. of Germany . | |
| 913531 | 6/1954 | Fed. Rep. of Germany . | |
| 0723127 | 3/1980 | U.S.S.R. | 299/14 |
| 0724731 | 4/1980 | U.S.S.R. | 299/14 |

OTHER PUBLICATIONS

H. Fleissner, "Die Trocknung der Brennstoffe und die Asberrichnische Kohlenwirtschaft," Sparwittschaft, Wien, 1927, Haft 10, pp. 499–561.

D. van Krevelen, "Graphical Statistical Method for the Study of Structure and Reaction Processes of Coal," Fuel 29 (1950), No. 12, pp. 269–284.

D. Kreulen, Inkohlung und Oxydation. Freiberger Forschungsheft, A 244 (1962), pp. 46–59.

J. B. Murray and D. G. Evans, "The Brown Coal/Water System: Part 3. Thermal Dewatering of Brown Coal Fuel", 1972, vol. 15, Oct., pp. 290–296.

*Primary Examiner*—Jerome W. Massie, IV
*Assistant Examiner*—William P. Neuder
*Attorney, Agent, or Firm*—Mark A. Smith

[57] ABSTRACT

A method for upgrading coal in-situ is disclosed in which a treatment zone is established around an energy source placed in a cavity within a coal seam and the pore structure of the coal substantially irreversibly collapses as moisture is driven off. The energy source provides either evaporative energy such as heat or a combination of heat and pressure in-situ. Resorption of water returning to the treatment zone during cooling of the coal prior to mining is limited due to the pore collapse.

21 Claims, 1 Drawing Sheet

IN-SITU COAL DRYING

BACKGROUND OF THE INVENTION

This invention relates to a method for upgrading coal and, more particularly, a method for upgrading coal in-situ prior to mining.

Coal is graded by specific heat value, that is its energy output per unit weight. Excess moisture content substantially reduces the grade of the coal and lowers its market value accordingly. Further, the same excess moisture that lowers the grade of the coal also represents extra weight which increases the cost of transportation to the user. Thus, both the available sales price and the transportation cost provide incentive to reduce or eliminate excess moisture present in coal before it is mined.

Western subbituminous coal obtained from strip mining operations provides a great percentage of coal used in the United States. Here the seams of minable coal may be 50 to 100 feet thick, but the coal often has a high moisture content. In fact the coal seams are often within aquifers and, even after applying known draining techniques, a remaining moisture content of as much as 20–30%, and higher, is typical. Only about 1–3% of this moisture is surface moisture provided the coal is properly drained during mining and the rest remains as pore moisture, sometimes called inherent moisture, within the pores of the coal.

Past drying techniques have been based on processing the coal through fluid beds or other high temperature convection furnaces or conducting coal slurries through pressure vessels for combined temperature and pressure processing. However, the expense of such operations has limited their use. Further, such techniques are often only employed as preprocessing after the coal, together with its excess moisture, has already been transported to a site for use.

SUMMARY OF THE INVENTION

It is therefore an object of the present invention to significantly upgrade coal prior to its mining. Toward the fulfillment of this and other objects, a method of upgrading coal in accordance with the present invention provides for establishing a treatment zone of substantially irreversible pore collapse within a seam of coal. The specific mechanism most appropriate for initiating pore collapse is determined by the local structure of the coal seam. In the application of the preferred embodiment for local structure with low permeability that will hold pressure, pores are collapsed in a treatment zone by adding heat in combination with increasing the localized pressure. Where the local structure is highly permeable and therefore unsuitable for holding pressure, the treatment zone is established as an evaporation zone within a seam of coal, evaporating moisture from the coal within the evaporation zone and driving the water vapor evaporated from the coal out from the evaporation zone.

BRIEF DESCRIPTION OF THE DRAWINGS

The description above, as well as further objects, features and advantages of the present invention will be more fully appreciated by reference to the following detailed description of the preferred embodiment which should be read in conjunction with the accompanying drawings in which.

DETAILED DESCRIPTION OF THE PREFERRED EMBODIMENT

Figure 1:
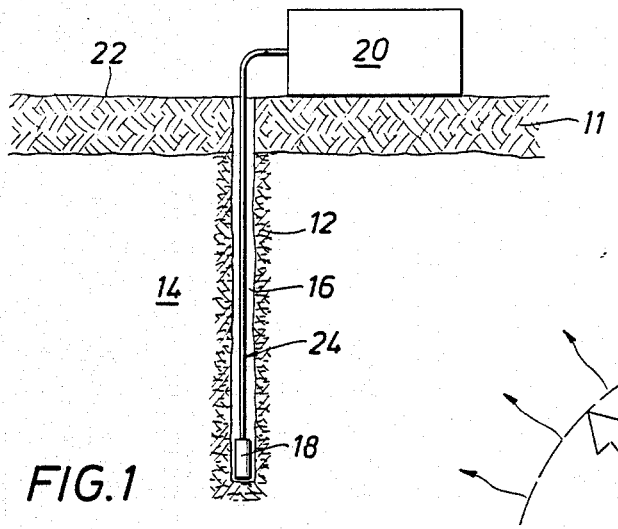
FIG. 1 is a cross sectional view of a seam of coal in which a method of upgrading coal in accordance with the present invention is being practiced.

FIG. 1 illustrates a preferred method for establishing a treatment zone 10 of substantially irreversible pore collapse (see FIG. 2) for upgrading coal 12 in-situ within a coal seam 14 located beneath an overburden 11 in accordance with the present invention. In this embodiment a cavity, here borehole 16, is established through the overburden and into the coal seam and an energy source 18 is placed within the borehole. In some embodiments the cavity is enlarged at the position of the energy source. Energy source 18 is effective to substantially irreversibly collapse a significant amount of the pores within the coal and is connected to a surface facility or control member 20 on surface 22 through a supply line 24.

The presently preferred embodiment for a coal seam having low permeability and which is therefore capable of holding pressure utilizes a means for injecting low quality steam as energy source 18. Steam may be injected into cavity 16 by generation in-situ in which case energy source 18 is a downhole steam generator provided with feedwater and fuel or electricity for steam generation through supply lines 24 from surface facilities 20. Alternatively, steam may be generated at surface facilities 20 and piped downhole through supply line 24 to a nozzle serving as energy source 18. In either case it will be desired to seal cavity 16 about the supply line 24 to hold pressure within treatment zone 10.

Figure 2:
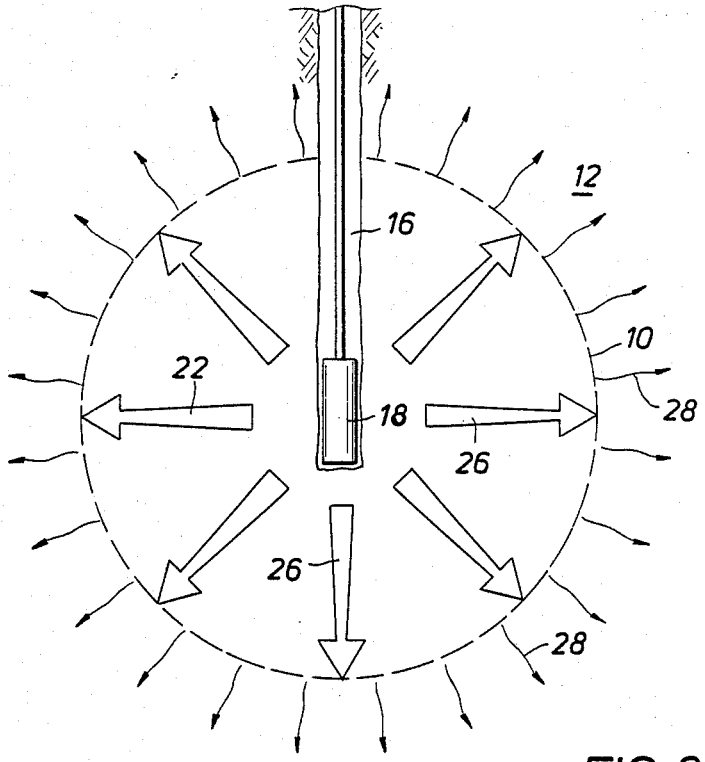
FIG. 2 is a cross sectional view of a treatment zone established in accordance with the present invention.

Activating energy source 18 of this embodiment delivers steam to treatment zone 10 where heat is delivered to the coal and pressure is exerted from energy source 18 as illustrated in FIG. 2 by arrows 26 representing an energy flux from energy source 18. In the preferred embodiment, the pressure exceeds the vapor pressure of water at the elevated temperature within the coal seam and hot condensed steam locally penetrates the coal seam as a liquid at the heart of the treatment zone. A steam temperature greater than 150° C. (and most preferably at 340° C.) and a corresponding pressure are presently preferred.

A net upgrading of coal is achievable by this embodiment despite the direct addition of water to coal seam 14 because the combination of heat and pressure causes pore collapse in the coal releasing pore moisture from the coal despite the presence of surrounding water. Pore moisture lost from the coal is illustrated by arrows 28 in FIG. 2. The pore moisture released as well as water added to the coal seam from injection may join the water of the indigenous aquifer, if any. Alternatively, condensed steam not easily driven into the coal seam may be withdrawn from the borehole for recirculation after it gives up its latent energy to the coal during condensation at or near the cavity.

Figure 3:
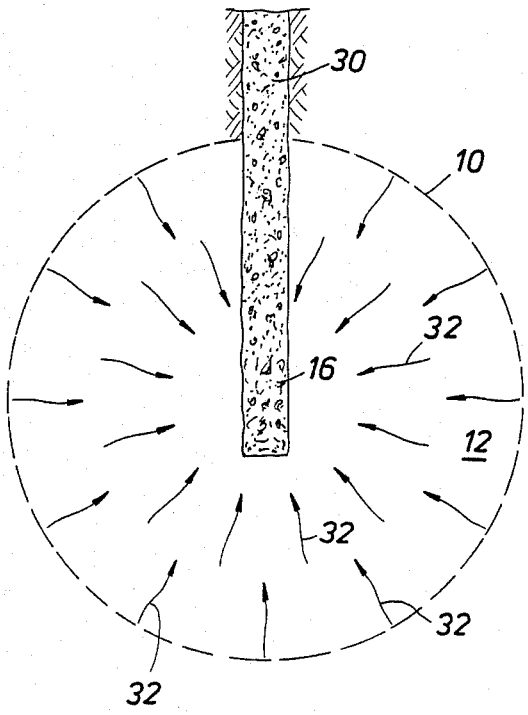
FIG. 3 is a cross sectional view of a treatment zone in which water is migrating back into the treatment zone.

After a desired amount of pore collapse has occurred, energy source 18 is withdrawn from cavity 16 and a plug 30 may fill the cavity while coal 12 cools from its elevated temperature. This cooling may take several months to a year or more during which time there will be a minor net increase in water migrating into the treatment zone as water within the treatment zone cools and contracts from its former thermally expanded volume. Arrows 32 of FIG. 3 represent the migration of water into treatment zone 10, however, this water will not resorb into the coal and thereby return it to its former moisture content because the pore collapse instigated by the combination of heat and pressure is substantially irreversible. Neither will the pore moisture driven off nor the water added by steam injection materially increase the surface moisture of the coal after conventional draining techniques are used in mining coal 12 of coal seam 14.

However, the local structure of some coal seams is too permeable to hold pressure well enough to support upgrading by the heat and pressure embodiment described above. In this case, pore collapse is achieved by heat alone in sufficient quantities to evaporate pore moisture from the coal.

One embodiment is suitable only where the local structure of the coal seam permits sufficient isolation of the coal to permit controlled in-situ combustion. This embodiment utilizes an open ignition device for energy source 18 illustrated in FIGS. 1 and 2. In this case, supply line 24 supplies oxygen from surface facilities 20 necessary to sustain combustion until sufficient water vapor has been driven from treatment zone 10. The substantial upgrading of the remaining coal in the treatment zone can more than compensate for the coal consumption in such an embodiment. Flue gas from combustion may be taken above ground and scrubbed before release to the atmosphere or may be partially or wholly forced into the coal seam.

Alternatively, where the coal seam is not so well isolated as to be suitable for direct combustion, energy source 18 may be a heating element effective to transfer heat to coal 12 without burning it, such as a combustion device fired within an enclosed housing. In this instance, both fuel and oxygen are provided through supply line 24. Further, the heating element may be an electric heater or another source of evaporative energy, such as a microwave generator, in embodiments in which supply lines 24 are electric power lines. Details of these and other sources of evaporative energy will be apparent to those skilled in the art upon reading this disclosure.

FIG. 2 illustrates the method of the present invention after the energy source, heating element 18 in this embodiment, is lowered within borehole 16 and is activated. Arrows 26 illustrate an energy or heat flux from energy source 18 moving through coal 12 of coal seam 14. This energy evaporates water within coal 12 and the steam created increases the local pressure forcing steam from the treatment zone which is shown in dotted outline and designated with reference number 10. Water vapor being driven from treatment zone 10 is illustrated by arrows 28.

The heat flux evaporates the surface moisture of the coal and progresses to evaporate a significant portion of the water within the pores of coal 12 throughout treatment zone 10. Some of the pores within the coal collapse substantially irreversibly as the moisture evaporates and is driven off, thereby permanently diminishing the ability of the coal to resorb moisture.

When the desired amount of moisture has been driven from coal 12 throughout treatment zone 10, energy source 18 is deactivated and removed from borehole 16. If the combustion of the coal itself is used as the heat source, the combustion is extinguished. This can be accomplished by stopping the flow of oxygen and is facilitated by the presence of overburden 11. It is then preferred to fill in borehole 16 with plug 30 to isolate the treatment zone 10 from the atmosphere while it is allowed to cool prior to mining in order to reduce the chance of spontaneous combustion. Again, this cooling may require several months to a year or longer. Water vapor driven from the treatment zone will condense as it cools and some of the water will migrate back into evaporation zone 10. The migration of water condensate is illustrated with arrows 32 for this embodiment. However, the irreversible collapse of pores within coal 12 in the treatment zone prevents the coal from resorbing as much moisture as the coal had contained before treatment. Following cooling, the upgraded coal is ready for mining through conventional techniques.

Thus, the method of the present invention provides a way to significantly upgrade coal in-situ, prior to mining at a minimal investment in capital equipment.

Other modifications, changes and substitutions are intended in the foregoing disclosure and in some instances, some features of the invention will be employed without a corresponding use of other features. Accordingly, it is appropriate that the appended claims be construed broadly and in a manner consistent with the spirit and scope of the present invention.

What is claimed is:

1. A method for mining coal upgraded within a coal seam comprising:

creating a cavity within the coal seam;

placing a source of energy within the cavity, effective to substantially irreversibly collapse pores within a treatment zone in the coal seam;

activating the energy source;

driving pore moisture from the coal;

substantially irreversibly collapsing pores in the coal within the treatment zone of the coal seam, thereby reducing the ability of the coal to resorb pore moisture; and removing the upgraded coal from the seam.

2. A method for mining coal in accordance with claim 1 wherein activating the source of energy comprises providing heat energy effective to increase the temperature of the coal throughout the treatment zone.

3. A method for mining coal in accordance with claim 2 wherein driving the pore moisture from the coal comprises evaporating the pore moisture from the coal.

4. A method for mining coal in accordance with claim 2 wherein activating the source of energy further comprises increasing the localized pressure within the treatment zone.

5. A method for mining coal in accordance with claim 4 wherein activating the source of energy comprises injecting steam into the cavity.

6. A method for mining coal in accordance with claim 5 wherein injecting steam into the cavity comprises:

generating steam in a surface facility; and piping steam into the cavity.

7. A method for mining coal in accordance with claim 5 wherein placing the souce of energy within the cavity comprises placing a downhole steam generator supported by a surface facility within the cavity.

8. A method for mining coal in accordance with claim 5 wherein the localized pressure is maintained above the vapor pressure of water at the increased temperature of the coal within the treatment zone.

9. A method for mining coal comprising:
creating a cavity within a seam of coal;
injecting steam into the cavity to elevate the temperature of the coal and increase the local pressure;
maintaining the localized pressure in the cavity above the vapor pressure of water at the elevated temperature until substantially irreversible pore collapse reduces the pore moisture within the coal in a treatment zone; and
removing the upgraded coal from the coal seam.

10. A method for mining coal in accordance with claim 9 wherein steam is injected above 150° C.

11. A method for mining coal in accordance with claim 10 wherein steam is injected at 340° C.

12. A method for mining coal in a coal seam comprising:
establishing a treatment zone within the coal seam;
evaporating moisture from the coal within the treatment zone to form water vapor;
driving the water vapor evaporated from the coal out of the treatment zone; and
removing the upgraded coal from the coal seam.

13. A method of mining coal in accordance with claim 12 wherein establishing the treatment zone comprises:
creating a cavity within the coal seam;
placing a source of evaporative energy within the cavity; and
activating the source of evaporative energy.

14. A method for mining coal in accordance with claim 12 wherein establishing the treatment zone comprises:
drilling a borehole into the coal seam;
lowering a heating element into the borehole; and
activating the heating element.

15. A method for mining coal in accordance with claim 14 wherein activating the heating element comprises initiating and sustaining open combustion within the coal seam.

16. A method of mining coal in accordance with claim 14 further comprising:
removing the heating element from the borehole;
extinguishing combustion within the borehole; and
plugging the borehole and allowing the coal to cool.

17. A method of mining coal in accordance with claim 14 wherein activating the heating element comprises:
initiating and sustaining combustion within an enclosed housing; and
transferring heat to the coal through the housing.

18. A method of mining coal in accordance with claim 14 wherein activating the heating element comprises supplying electrical power to an electric heating system.

19. A method of mining coal in accordance with claim 12 wherein evaporating moisture from the coal comprises:
evaporating surface moisture from the coal in the treatment zone; and
evaporating pore moisture from the coal in the treatment zone causing irreversible pore collapse.

20. A method of mining coal in accordance with claim 19 further comprising:
ceasing evaporation of moisture from the coal; and
allowing water vapor to condense in the treatment zone to a saturation level lower than the coal possessed prior to the irreversible pore collapse.

21. A method for mining coal in a coal seam comprising:
creating a cavity within the coal seam;
placing a source of evaporative energy within the cavity;
activating the source of evaporative energy;
evaporating moisture from the coal within a treatment zone adjacent the activated source of evaporative energy to form water vapor comprising the following steps:
evaporating surface moisture from the coal in the treatment zone; and
evaporating pore moisture from the coal in the treatment zone causing irreversible pore collapse;
driving the water vapor from the coal out of the treatment zone;
deactivating the source of evaporative energy;
allowing the coal to cool and the water vapor to condense and partially migrate back to the treatment zone where the saturation level of the coal has been reduced due to the irreversible pore collapse; and
removing the upgraded coal from the coal seam.

* * * * *